US011217389B2

(12) United States Patent
Murakami et al.

(10) Patent No.: US 11,217,389 B2
(45) Date of Patent: Jan. 4, 2022

(54) METHOD AND APPARATUS FOR MANUFACTURING COIL COMPONENT

(71) Applicant: Murata Manufacturing Co., Ltd., Kyoto-fu (JP)

(72) Inventors: Takashi Murakami, Nagaokakyo (JP); Akio Igarashi, Nagaokakyo (JP); Takao Miyamoto, Nagaokakyo (JP); Kazuo Miyake, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 331 days.

(21) Appl. No.: 16/291,806

(22) Filed: Mar. 4, 2019

(65) Prior Publication Data

US 2019/0279815 A1 Sep. 12, 2019

(30) Foreign Application Priority Data

Mar. 7, 2018 (JP) ..... JP2018-040945
Nov. 7, 2018 (JP) ..... JP2018-209883

(51) Int. Cl.

| | |
|---|---|
| ***H01F 41/10*** | (2006.01) |
| ***H01F 27/24*** | (2006.01) |
| ***H01F 27/28*** | (2006.01) |
| ***H01F 17/04*** | (2006.01) |

(52) U.S. Cl.

CPC ..... *H01F 41/10* (2013.01); *H01F 17/045* (2013.01); *H01F 27/24* (2013.01); *H01F 27/2828* (2013.01)

(58) Field of Classification Search

CPC ..... H01F 41/10
See application file for complete search history.

(56) References Cited

U.S. PATENT DOCUMENTS

2006/0022788 A1* 2/2006 Sasamori ..... H01F 17/043 336/208

FOREIGN PATENT DOCUMENTS

| | | | |
|---|---|---|---|
| CN | 103730229 | A | 4/2014 |
| CN | 104541347 | A | 4/2015 |
| JP | H5-63040 | U | 8/1993 |
| JP | H06-69036 | A | 3/1994 |
| JP | H06-151215 | A | 5/1994 |
| JP | 2015-035473 | A | 2/2015 |
| JP | 2015-038947 | A | 2/2015 |

OTHER PUBLICATIONS

An Office Action issued by the China National Intellectual Property Administration dated Nov. 3, 2020, which corresponds to Chinese Patent Application No. 201910155301.4 and is related to U.S. Appl. No. 16/291,806 with English language translation.

(Continued)

*Primary Examiner* — Daniel H Lee
(74) *Attorney, Agent, or Firm* — Studebaker & Brackett PC

(57) ABSTRACT

A method of manufacturing a coil component includes a heating step of locally heating metal terminals while the metal terminals are supported by a pressing member having a contact surface capable of coming into contact with the metal terminals in a state where an adhesive is disposed between the metal terminals and a drum core.

13 Claims, 6 Drawing Sheets

(56) References Cited

OTHER PUBLICATIONS

An Office Action mailed by China National Intellectual Property Administration dated May 24, 2021 which corresponds to Chinese Patent Application No. 201910155301.4 and is related to U.S. Appl. No. 16/291,806 with English language translation.
An Office Action; "Notice of Reasons for Refusal," mailed by the Japanese Patent Office dated Apr. 20, 2021, which corresponds to Japanese Patent Application No. 2018-209883 and is related to U.S. Appl. No. 16/291,806 with English language translation.
An Office Action; "Notice of Reasons for Refusal," mailed by the Japanese Patent Office dated Sep. 14, 2021, which corresponds to Japanese Patent Application No. 2018-209883 and is related to U.S. Appl. No. 16/291,806 with English translation.

* cited by examiner

METHOD AND APPARATUS FOR MANUFACTURING COIL COMPONENT

CROSS-REFERENCE TO RELATED APPLICATIONS

This application claims benefit of priority to Japanese Patent Application No. 2018-040945, filed Mar. 7, 2018, and Japanese Patent Application No. 2018-209883, filed Nov. 7, 2018 the entire contents of both are incorporated herein by reference.

BACKGROUND

Technical Field

The present disclosure relates to a method and apparatus for manufacturing a coil component.

Background Art

One known coil component is a common-mode choke coil in which a pair of wires are wound around a winding core portion of a drum core and the ends of the wires are electrically connected to electrode portions on flange portions on the drum core as described, for example, in Japanese Unexamined Patent Application Publication No. 2015-35473. The coil component described in the patent document uses metal terminals joined and fixed to the flange portions as the electrode portions.

In a method for manufacturing the above-described coil component, first, a core is prepared, and then, metal terminals are fixed to the core. Wires are wound around a winding core portion of the core, to which the metal terminals are fixed, and become electrically connected to the metal terminals. In this way, the coil component is manufactured.

In the above-described method for manufacturing the coil component, a jig for fixing the positions of the metal terminals and the core may be used to fix the core and the metal terminals by an adhesive with high positional accuracy. In this case, the adhesive is cured by inserting the core and the metal terminals into an oven in the state where the jig is attached to them and heating them. The jig is large enough to cover and fix the core and the metal terminals in order to fix the positions of the core and the metal terminals. Because it is necessary to heat them, including the jig, which has a thermal capacity larger than that of each of the core and the metal terminals, it takes time to raise the temperature in the oven in curing the adhesive, and in addition, it is difficult to finely control the temperature. Thus, the adhesive may not be efficiently heated.

SUMMARY

Accordingly, the present disclosure provides a method and apparatus for manufacturing a coil component that are capable of efficiently heating an adhesive.

According to preferred embodiments of the present disclosure, a method for manufacturing a coil component is provided. The coil component includes a core including a winding core portion and a pair of flange portions on opposite ends of the winding core portion, at least one metal terminal joined and fixed to a corresponding one of the pair of flange portions, and a wire wound around the winding core portion and including an extended portion electrically connected to the metal terminal. The method includes a heating step of locally heating the metal terminal while the metal terminal is supported by a pressing member having a contact surface capable of coming into contact with the metal terminal in a state where a thermosetting adhesive is disposed between the metal terminal and the core.

In this configuration, because while the metal terminal is supported by the pressing member having the contact surface, which is capable of coming into contact with the metal terminal, the metal terminal is heated and the adhesive between the metal terminal and the core is heated, the adhesive can be cured by partial heating, and the adhesive can be efficiently heated.

According to preferred embodiments of the present disclosure, in the above-described method for manufacturing the coil component, the heating step may be performed while the metal terminal is pressed by the pressing member from the metal terminal side toward the core side. In this configuration, because the heating step is performed by pressing the metal terminal by the heating section in contact with the metal terminal from the metal terminal side toward the core side, the heat can be applied to only the portion to be subjected to thermocompression bonding of the metal terminal. That is, because the adhesive can be cured before the heat is conveyed to a jig having a large thermal capacity, the adhesive can be heated more efficiently, in comparison with the case where the core and metal terminal are heated together with jigs in the state where the core and the metal terminal are fixed by the jigs.

According to preferred embodiments of the present disclosure, the above-described method for manufacturing the coil component may include a grinding step of grinding the contact surface of the pressing member to be in contact with the metal terminal before the heating step. In this configuration, if a foreign substance, such as an adhesive, becomes deposited on the contact surface, for example, the foreign substance can be eliminated in the grinding step of grinding the contact surface of the heating section to be in contact with the metal terminal before the heating step.

According to preferred embodiments of the present disclosure, the above-described method for manufacturing the coil component may further include a holding step of preparing a hoop element integral with the metal terminal and of holding the core in a predetermined position by an elastic force of the hoop element before the heating step. In this configuration, because the holding step of holding the core in the predetermined position by the elastic force of the hoop element integral with the plurality of metal terminals before the heating step is included, misalignment of the core after the core is inserted into the hoop element can be suppressed.

According to preferred embodiments of the present disclosure, in the method for manufacturing the coil component, the pressing member may be a heater chip. In this configuration, because the heater chip is used as the pressing member and it generates heat by itself, the generated heat can be efficiently conveyed to the adhesive. In addition, misalignment can be prevented by the application of pressure to an end surface of the metal terminal and a side surface of the flange portion in the core.

According to preferred embodiments of the present disclosure, an apparatus for manufacturing a coil component is provided. The coil component includes a core including a winding core portion and a pair of flange portions on opposite ends of the winding core portion, at least one metal terminal joined and fixed to a corresponding one of the pair of flange portions, and a wire wound around the winding core portion and including an extended portion electrically connected to the metal terminal. The apparatus includes a heating section having a contact surface capable of coming into contact with the metal terminal in a state where a thermosetting adhesive is disposed between the metal terminal and the core and configured to heat the metal terminal with the contact surface disposed therebetween. In this configuration, because the adhesive can be cured by the heating section having the contact surface capable of coming into contact with the metal terminal, it is not necessary to cure the adhesive in the state where the jig is attached, and it can be efficiently heated.

With the method and apparatus for manufacturing the coil component according to preferred embodiments of the present disclosure, the adhesive can be efficiently heated.

Other features, elements, characteristics and advantages of the present disclosure will become more apparent from the following detailed description of preferred embodiments of the present disclosure with reference to the attached drawings.

DETAILED DESCRIPTION

An embodiment will be described below. In accompanying drawings, for facilitating understanding, constituent elements may be magnified. The dimensional ratios of the constituent elements in a drawing may be different from the real ones or ones illustrated in other drawings.

Figure 1:
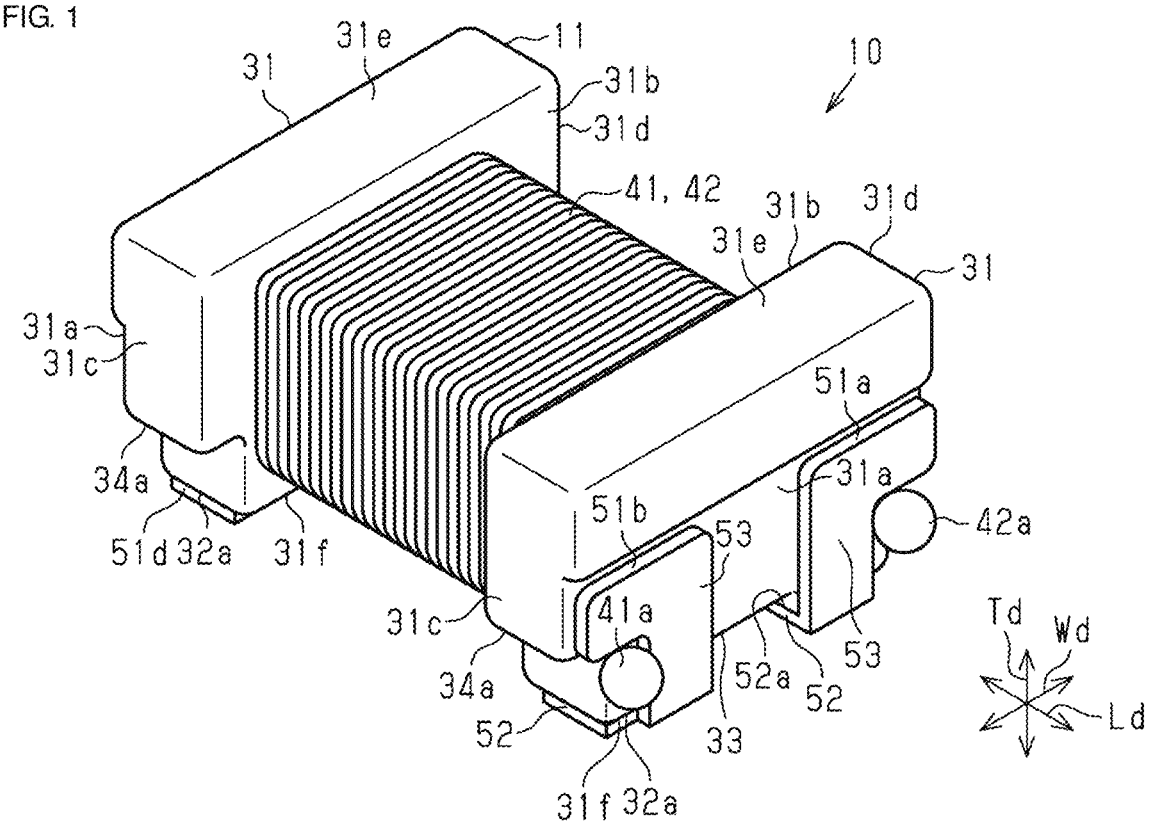
FIG. 1 is a perspective view of a coil component according to an embodiment of the present disclosure.

FIG. 1 is a perspective view of a coil component 10 manufactured by a manufacturing method according to an embodiment of the present disclosure. In FIG. 1, as one example of the coil component 10, a common-mode choke coil is illustrated. The coil component 10 includes a drum core 11, first and second wires 41 and 42 wound around the drum core 11, and metal terminals 51*a*, 51*b*, 51*c*, and 51*d* (in FIG. 1, only 51*a*, 51*b*, and 51*d* are illustrated) attached to the drum core 11.

Figure 2:
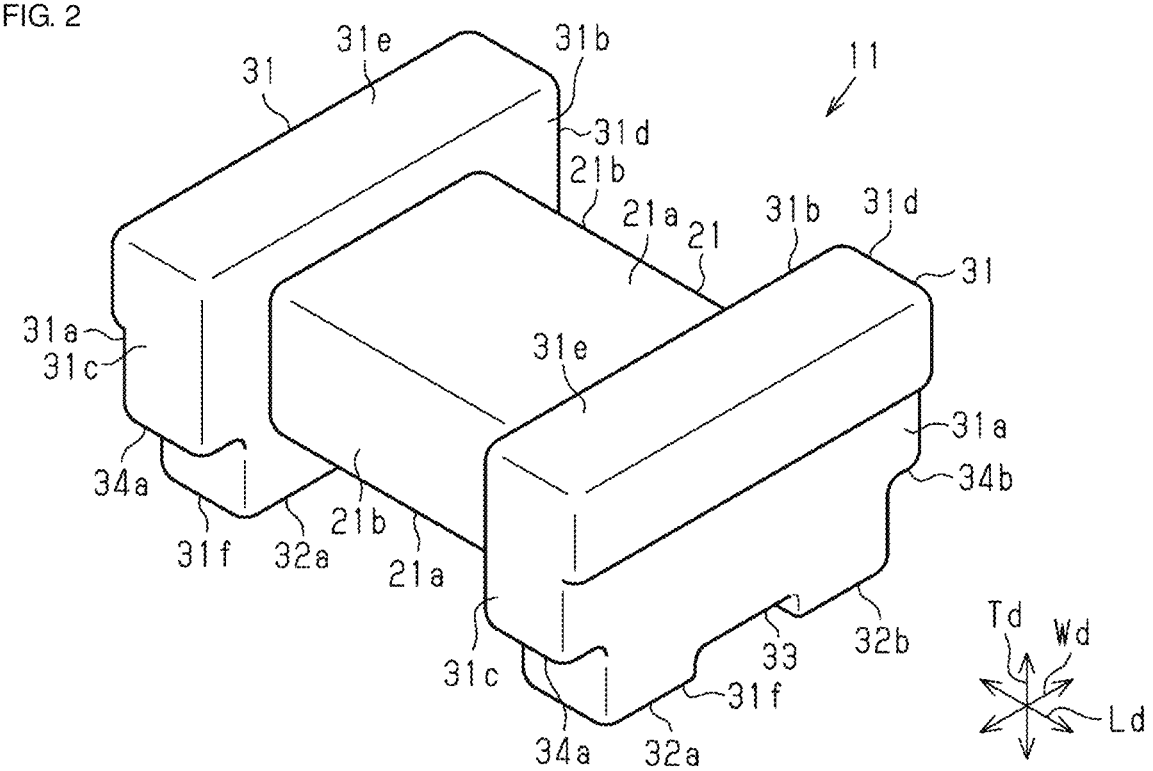
FIG. 2 is a perspective view of a core according to the embodiment.

As illustrated in FIG. 2, the drum core 11 includes a winding core portion 21 having a substantially rectangular parallelepiped shape and a pair of flange portions 31 on opposite end portions of the winding core portion 21. The winding core portion 21 and the pair of flange portions 31 are integral with each other.

Here, in the present specification, as illustrated in FIGS. 1 and 2, a direction in which the pair of flange portions 31 are arranged (aligned) is defined as "longitudinal direction Ld," a direction that is substantially perpendicular to the "longitudinal direction Ld" and that is the vertical direction in FIGS. 1 and 2 is defined as "height direction (thickness direction) Td," and a direction substantially perpendicular to both the "longitudinal direction Ld" and "height direction Td" is defined as "width direction Wd."

The drum core 11 in the present embodiment may be made of a magnetic material, such as Ni—Cu—Zn ferrite. The drum core 11 may be made of magnetic materials other than the Ni—Cu—Zn ferrite.

As illustrated in FIGS. 1 and 2, the first and second wires 41 and 42 are wound around the winding core portion 21. The winding core portion 21 may have a substantially rectangular parallelepiped shape extending along the longitudinal direction Ld. The central axis of the winding core portion 21 extends substantially in parallel with the longitudinal direction Ld. The winding core portion 21 includes a pair of principal surfaces 21*a* opposed to each other in the height direction Td and a pair of side surfaces 21*b* opposed to each other in the width direction Wd.

In the present specification, "substantially rectangular parallelepiped shapes" include substantially rectangular parallelepiped shapes having corner portions beveled (chamfered), substantially rectangular parallelepiped shapes having corner or edge portions rounded as needed, and substantially rectangular parallelepiped shapes having corner or edge portions depressed. The principal surfaces and side surfaces may have projections and depressions in part or in entirety.

As illustrated in FIGS. 1 and 2, each of the pair of flange portions 31 may have a substantially rectangular parallelepiped shape short in the longitudinal direction Ld. The flange portion 31 protrudes toward the height direction Td and width direction Wd such that it extends out around the winding core portion 21. Specifically, the plane shape of the flange portion 31 as seen from the longitudinal direction Ld extends out in the height direction Td and width direction Wd with respect to the winding core portion 21.

The flange portion 31 includes a pair of principal surfaces 31*a* and 31*b* opposed to each other in the longitudinal direction Ld, a pair of side surfaces 31*c* and 31*d* opposed to each other in the width direction Wd, and a pair of side surfaces 31*e* and 31*f* opposed to each other in the height direction Td. The principal surface 31*b* in one of the flange portions 31 is opposed to the principal surface 31*b* in the other flange portion 31. That is, the principal surfaces 31*b* in the flange portions 31 correspond to opposed surfaces.

Each of the flange portions 31 includes two projecting surfaces 32*a* and 32*b*, a central recessed portion 33 forming a gap between the two projecting surfaces 32*a* and 32*b*, and external recessed portions 34*a* and 34*b* positioned on opposite sides to the central recessed portion 33 with the projecting surfaces 32*a* and 32*b* disposed therebetween, on the side where the side surface 31*f* to be mounted on a substrate (not illustrated) is positioned. The projecting surfaces 32*a* and 32*b* extend beyond the central recessed portion 33 and the external recessed portions 34*a* and 34*b* in the height direction Td. In the present embodiment, the distance from the projecting surfaces 32*a* and 32*b* to the principal surface 21*a* of the winding core portion 21 that faces the substrate is set at approximately 0.1 mm to approximately 0.5 mm.

The first and second wires 41 and 42 are coated lead wires, are wound around the winding core portion 21 in the same winding direction, and constitute a coil conductor. As one example of each of the first and second wires 41 and 42, a coated lead wire with a dimeter in the range of approximately 15 μm to approximately 80 μm can be used. In the present embodiment, a coated lead wire with a dimeter of approximately 15 μm is used. The first and second wires 41 and 42 are wound around the winding core portion 21 with the same number of turns. As one example of each of the first and second wires 41 and 42, a wire containing copper, such as a wire made of an alloy of copper and nickel, can be used. The coating for the first and second wires 41 and 42 can be made of a resin material, such as imide-modified polyurethane or enamel.

The opposite end portions of the first and second wires 41 and 42 are arranged in the vicinity of the four external recessed portions 34*a* and 34*b* in total in a one-to-one relationship and form connection portions 41*a* and 42*a* electrically connected to the metal terminals 51*a*, 51*b*, 51*c*, and 51*d*. By welding the opposite end portions of the wires 41 and 42 to the metal terminals 51*a*, 51*b*, 51*c*, and 51*d*, the connection portions 41*a* and 42*a* and part of the metal terminals 51*a*, 51*b*, 51*c*, and 51*d* form welding balls. The method of connecting the first and second wires 41 and 42 and the metal terminals 51*a*, 51*b*, 51*c*, and 51*d* is not confined to welding, and another example of that method may be thermocompression bonding using a heater chip.

The pair of metal terminals 51*a* and 51*b* are disposed on the projecting surfaces 32*a* and 32*b* of one of the flange portions 31, respectively. Similarly, the pair of metal terminals 51*c* and 51*d* are disposed on the projecting surfaces of the other flange portion 31, respectively. That is, the four metal terminals 51*a*, 51*b*, 51*c*, and 51*d* in total are disposed on the drum core 11. The pair of metal terminals 51*a* and 51*b* are symmetrical with each other with respect to a line passing through the center of the winding core portion 21 in the width direction Wd. The pair of metal terminals 51*c* and 51*d* are symmetrical with each other with respect to the line passing through the center of the winding core portion 21 in the width direction Wd. The metal terminals 51*a*, 51*b*, 51*c*, and 51*d* are electrically connected to the end portions of the first and second wires 41 and 42, which are described below.

Each of the metal terminals 51*a*, 51*b*, 51*c*, and 51*d* includes a mounting portion 52 and an end surface portion 53, both of which have planer shapes. Each of the metal terminals 51*a*, 51*b*, 51*c*, and 51*d* is formed by die-cutting a single planar metal plate and bending it. Each of the metal terminals 51*a*, 51*b*, 51*c*, and 51*d* can be made of a metal material. Examples of that metal material may include phosphor bronze, oxygen free copper, tough pitch copper, brass, nickel silver, beryllium copper, and cupronickel.

The mounting portion 52 in each of the metal terminals 51*a*, 51*b*, 51*c*, and 51*d* is disposed such that its upper surface 52*a* is fixed to the projecting surface 32*a* or 32*b* of the flange portion 31 by an adhesive. The end surface portion 53 is continuous and integral with the end portion of the mounting portion 52. More specifically, when each of the metal terminals 51*a*, 51*b*, 51*c*, and 51*d* is seen from the width direction Wd, it is substantially L shaped. The end surface portion 53 is fixed to the principal surface 31*a* as an end surface of the flange portion 31 by an adhesive.

(Manufacturing Method)

Next, a method for manufacturing the coil component 10 having the above-described configuration is described.

First, the drum core 11 is prepared. Then, the metal terminals 51*a*, 51*b*, 51*c*, and 51*d* are fixed to the flange portions 31 of the drum core 11. After that, the wires 41 and 42 are wound around the drum core 11. Subsequently, the wires 41 and 42 are welded to the metal terminals 51*a*, 51*b*, 51*c*, and 51*d*.

Joining the drum core 11 and the metal terminals 51*a*, 51*b*, 51*c*, and 51*d* in the coil component 10 is mainly described below. In the following description, in the height direction Td, the side on which the projecting surfaces 32*a* and 32*b* are positioned is described as a lower side, and the direction in which the side surface 31*e* is positioned is described as an upper side.

First, an adhesive (thermosetting resin) is applied to the principal surfaces 31*a* and the projecting surfaces 32*a* and 32*b* of the flange portions 31 in the drum core 11 (applying step). After that, the application of the adhesive to the surfaces 31*a*, 32*a*, and 32*b* may be inspected by using, for example, a camera (application inspecting step).

Figure 3:
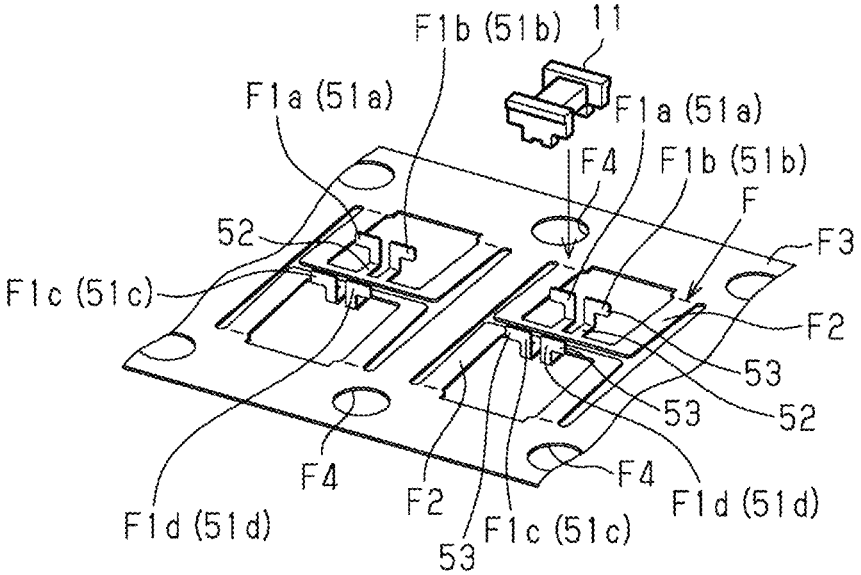
FIG. 3 is an illustration for describing a method for manufacturing the coil component.

Then, as illustrated in FIG. 3, a hoop element F including the plurality of metal terminals 51*a*, 51*b*, 51*c*, and 51*d* is prepared. Here, the hoop element F is described. The hoop element F is a belt-like metal plate. The hoop element F includes a plurality of grip portions F1*a*, F1*b*, F1*c*, and F1*d*, a coupling portion F2, and an edge portion F3. The plurality of grip portions F1*a*, F1*b*, F1*c*, and F1*d* are formed by being bent and correspond to the metal terminals 51*a*, 51*b*, 51*c*, and 51*d*. Specifically, the elements after the grip portions F1*a*, F1*b*, F1*c*, and F1*d* are separated from the coupling portion F2, which couples the edge portion F3 and grip portions F1*a*, F1*b*, F1*c*, and F1*d*, are the metal terminals 51*a*, 51*b*, 51*c*, and 51*d*, and the elements before they are separated are the grip portions F1*a*, F1*b*, F1*c*, and F1*d*. The grip portions F1*a* and F1*c* of the hoop element F are opposed to each other with a space corresponding to the length of the drum core 11 disposed therebetween. The grip portions F1*b* and F1*d* of the hoop element F are opposed to each other with the space corresponding to the length of the drum core 11 disposed therebetween. The edge portion F3 has pilot holes F4. The pilot holes F4 can receive pilot pins in a conveyance unit for conveying the hoop element F. When the conveyance unit is driven, the pilot pins are moved, and the hoop element F is conveyed with this movement. In the present embodiment, the hoop element F is conveyed by intermittently driving the pilot pins in the conveyance unit.

Figure 4:
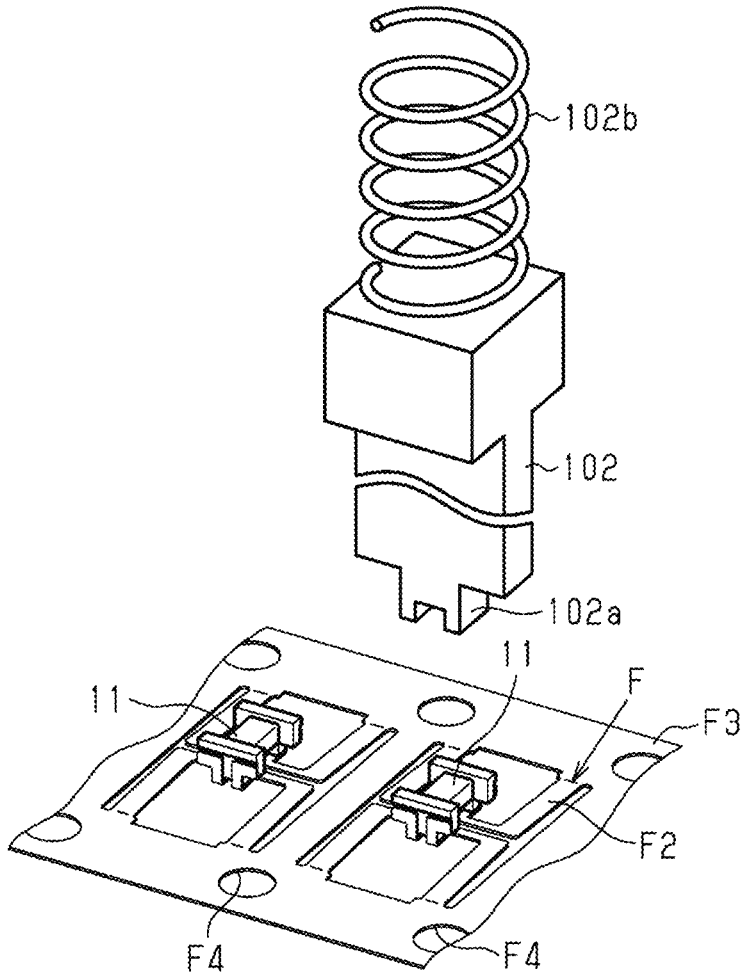
FIG. 4 is an illustration for describing the method for manufacturing the coil component.
Figure 5:
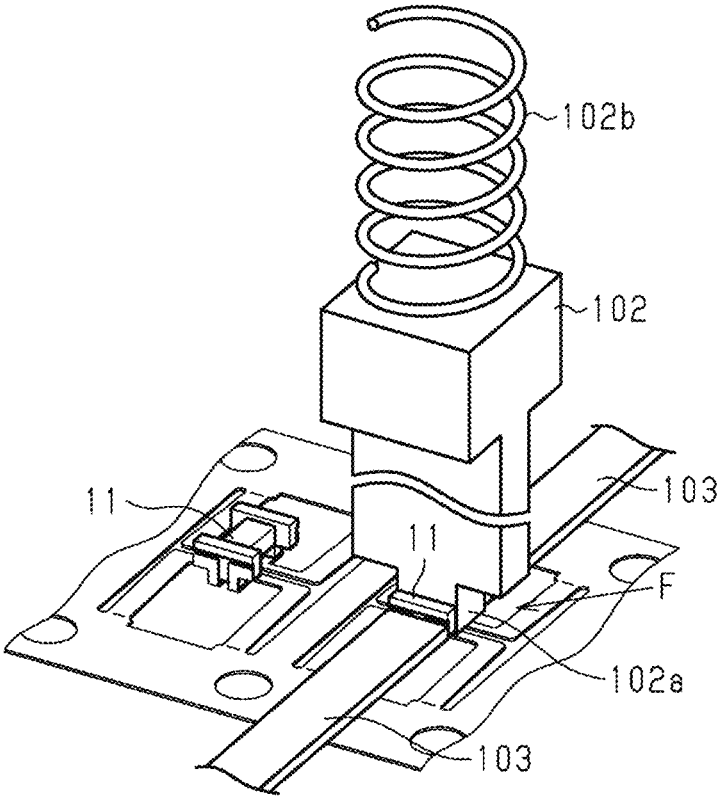
FIG. 5 is an illustration for describing the method for manufacturing the coil component.

The drum core 11 with the adhesive applied thereto is inserted into the hoop element F having the above-described configuration such that the principal surfaces 31*a* of the flange portions 31 in the drum core 11 are in contact with the metal terminals 51*a*, 51*b*, 51*c*, and 51*d*. Specifically, as illustrated in FIGS. 4 and 5, an upper-side jig 102 positioned on the side where the principal surface 21*a* that does not face the substrate of the winding core portion 21 in the drum core 11 is positioned is moved toward this principal surface 21*a*, and the winding core portion 21 of the drum core 11 is held by a leading end portion 102*a* of the upper-side jig 102. The upper-side jig 102 sucks the drum core 11 through a hole portion (not illustrated), keeps holding it, and inserts the drum core 11 into the hoop element F.

Figure 6:
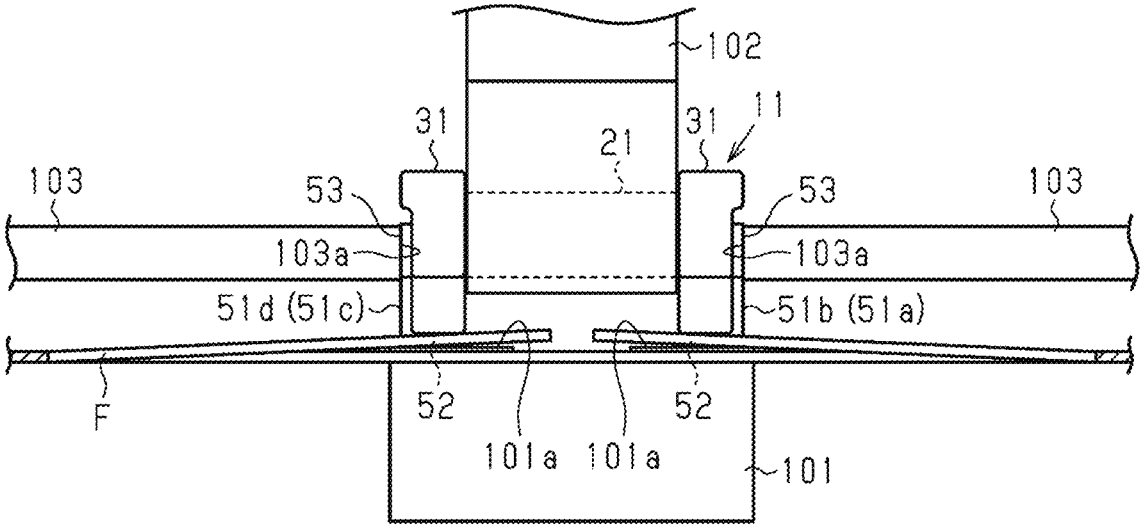
FIG. 6 is an illustration for describing the method for manufacturing the coil component.

At this time, the hoop element F may be deformed and developed to facilitate the insertion of the drum core 11 into the hoop element F. More specifically, as illustrated in FIG. 6, when the metal terminals 51*a*, 51*b*, 51*c*, and 51*d* in the hoop element F are pressed upward by a lower-side jig 101, the coupling portion F2 is warped. Thus, the above-described state in which the end surface portion 53 is an acute angle (larger than about 85 degrees and smaller than about 90 degrees, for example, about 87 degrees) is changed to the state in which the end surface portion 53 is an obtuse angle with respect to the hoop element F, the upper region of the end surface portion 53 becomes wider than the width of the drum core 11, and thus the drum core 11 can be easily inserted from above.

The lower-side jig 101 used in the present embodiment is positioned below the hoop element F and is attached to a driving portion (not illustrated) such that it can move upward and downward. The lower-side jig 101 includes a leading end portion 101*a* substantially parallel to the drum core 11 and hoop element F.

With the use of the above-described method, after the drum core 11 is inserted into the hoop element F, the grip portions F1*a*, F1*b*, F1*c*, and F1*d* pressed upward by the lower-side jig 101 are returned, and the drum core 11 and the grip portions F1*a*, F1*b*, F1*c*, and F1*d* are adjusted to positions for being heated. At this time, because the grip portions F1*a*, F1*b*, F1*c*, and F1*d* (hoop element F) act in a direction in which they grip the drum core 11, misalignment of the drum core 11 and the grip portions F1*a*, F1*b*, F1*c*, and F1*d* (metal terminals 51*a*, 51*b*, 51*c*, and 51*d*) can be suppressed. Moreover, because the coupling portion F2 functions as a leaf spring and a repulsive force of pressing from the drum core 11 back to the grip portions F1*a*, F1*b*, F1*c*, and F1*d* (metal terminals 51*a*, 51*b*, 51*c*, and 51*d*) is reduced, damage of the drum core 11 can be prevented. At this time, the lower-side jig 101 is in contact with the drum core 11. At this time, the drum core 11 is in the state where its position is fixed from above and below by the upper-side jig 102 and lower-side jig 101.

No urging member (elastic member), such as a spring, is disposed between the lower-side jig 101 and the driving portion. Thus, in mating the drum core 11 and the metal terminals 51*a*, 51*b*, 51*c*, and 51*d*, a reference plane can be maintained in forming it. Other configurations may also be used. For example, a configuration in which an urging member is disposed between the lower-side jig 101 and the driving portion may be used.

The upper-side jig 102 is urged to the lower side by an urging member 102*b*, such as a spring, and can hold the drum core 11 suitably. If the drum core 11 is pressed into the hoop element F too downward in arranging the drum core 11 in the hoop element F because of variations in the sizes of the drum cores 11, a repulsive force from the drum core 11 can be absorbed by the urging member 102*b*. This can suppress chipping of the drum core 11.

By adjusting the lower-side jig 101 and upper-side jig 102, the positions where the drum core 11 and grip portions F1*a*, F1*b*, F1*c*, and F1*d* are fixed are set. Each of the lower-side jig 101 and upper-side jig 102 may be made of a material having low thermal conductivity (e.g., zirconium oxide). In this configuration, heat supplied from a pressing member 103 can be efficiently provided to the adhesive.

Then, as illustrated in FIG. 6, the pressing member 103, which may be made of a heater chip, is moved toward the drum core 11, a leading end surface 103*a* being a contact surface of the pressing member 103 is pressed from the opposite sides of the drum core 11 in the longitudinal direction Ld toward the center of the drum core 11 and is made to come into contact with the end surface portions 53 of the grip portions F1*a*, F1*b*, F1*c*, and F1*d* (metal terminals 51*a*, 51*b*, 51*c*, and 51*d*). In the state where the pressure is applied to the drum core 11, the end surface portions 53 of the metal terminals 51*a*, 51*b*, 51*c*, and 51*d* are heated by the pressing member 103, that is, are connected by thermocompression bonding. The heating is performed in the state where the drum core 11 is inserted in the hoop element F and they are linked together. At this time, the lower-side jig 101 is heated by another heating means, thus heating the mounting portions 52 of the grip portions F1*a*, F1*b*, F1*c*, and F1*d* (metal terminals 51*a*, 51*b*, 51*c*, and 51*d*). In this way, a heating step for the adhesive is carried out by heating the end surface portions 53 and mounting portions 52. At this time, because the pressing member 103 comes into contact in the state where the drum core 11 is fixed by the lower-side jig 101 and upper-side jig 102, the position can be controlled from above and below and from the right and left, and the heating can be performed in the state where the drum core 11 is fixed in a predetermined position. Accordingly, the adhesive can be cured with high positional accuracy. When a heater chip is used as the pressing member 103, because the pressing member 103 generates heat by itself, the generated heat can be efficiently conveyed from the leading end surface 103*a* to the adhesive. In addition, misalignment can be suppressed by the application of pressure to the end surface portions 53 of the metal terminals 51*a*, 51*b*, 51*c*, and 51*d* and the principal surface 31*a* of the flange portion 31. The pressing member 103, which is made of a heater chip in the present embodiment, may not generate heat by itself. The heating may be performed by blowing heated air to the metal terminals by using another element, such as an air heater.

As previously described, because the pressing member 103 performs thermocompression bonding, the adhesive is uniformly spread between the end surface portions 53 of the metal terminals 51*a*, 51*b*, 51*c*, and 51*d* and the principal surfaces 31*a* of the drum core 11.

Figure 8:
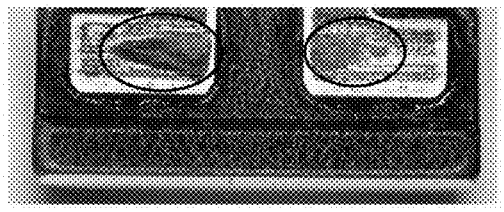
FIG. 8 is a photograph taken after metal terminals are joined to the core.
Figure 9A:
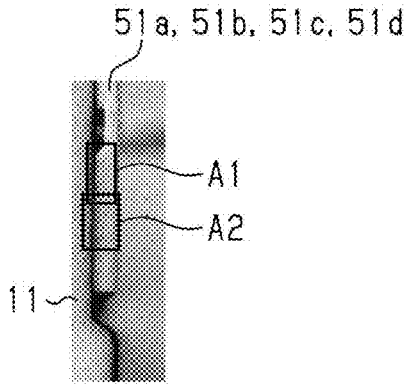
FIGS. 9A, 9B, and 9C are illustrations for describing a state where the metal terminals are joined to the drum core.
Figure 9B:
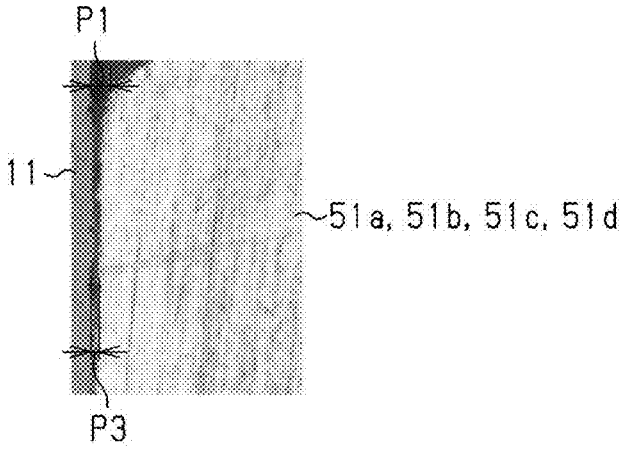
Figure 9C:
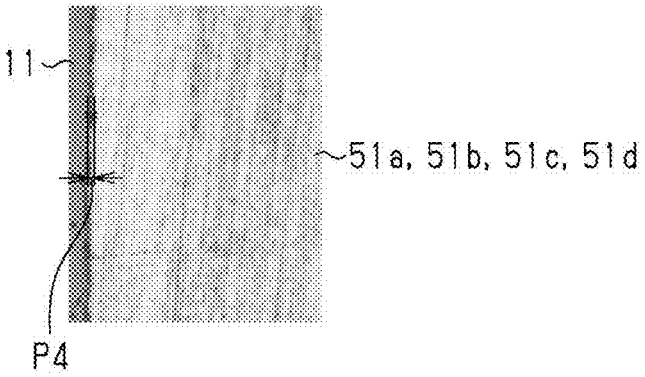
Figure 10A:
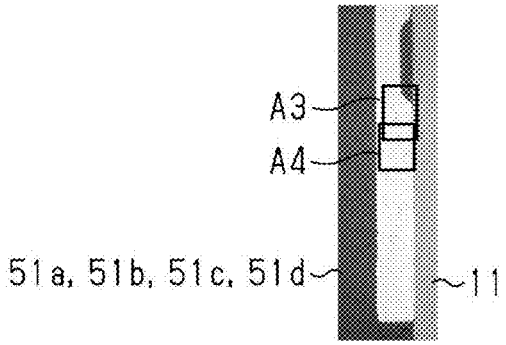
FIGS. 10A, 10B, and 10C are illustrations for describing the state where the metal terminals are joined to the drum core.
Figure 10B:
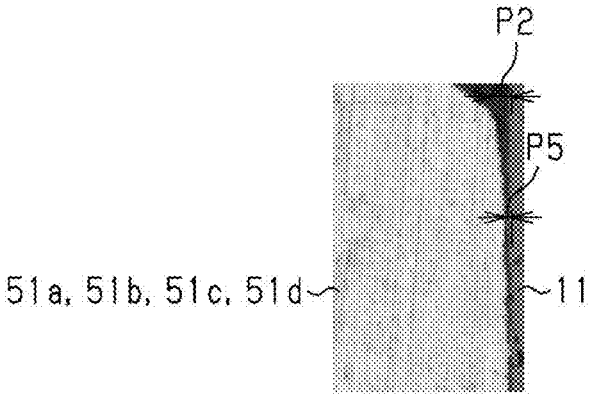
Figure 10C:
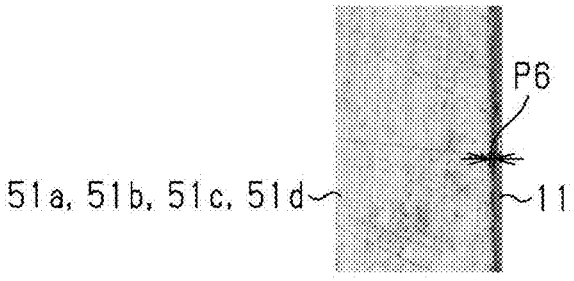

FIGS. 9A, 9B, 9C, 10A, 10B, and 10C are enlarged views of the metal terminals 51*a*, 51*b*, 51*c*, and 51*d* and drum core 11 after curing. FIGS. 9B and 9C illustrate enlarged areas A1 and A2 in FIG. 9A, respectively. FIGS. 10B and 10C illustrate enlarged areas A3 and A4 in FIG. 10A, respectively. FIGS. 9A, 9B, 9C, 10A, 10B, and 10C reveal that after curing, the thickness of the adhesive between the metal terminals 51*a*, 51*b*, 51*c*, and 51*d* and the drum core 11 is the maximum at locations P1 and P2 and may be on the order of 5 μm. The thicknesses of the adhesive at many other locations P3, P4, P5, and P6 are no more than about 5 μm. The application of pressure, together with heat, by the pressing member 103, enables the adhesive to be substantially uniformly spread. Because the metal terminals 51*a*, 51*b*, 51*c*, and 51*d* are plated with soft tin, the above-described heating step, by which the pressing member 103 performs thermocompression bonding thereon, leaves traces of applied pressure (sections surrounded by circles in FIG. 8). The traces of applied pressure may be removed by grinding or other process. Such trances may not be left, depending on the degree of the applied pressure.

Figure 7:
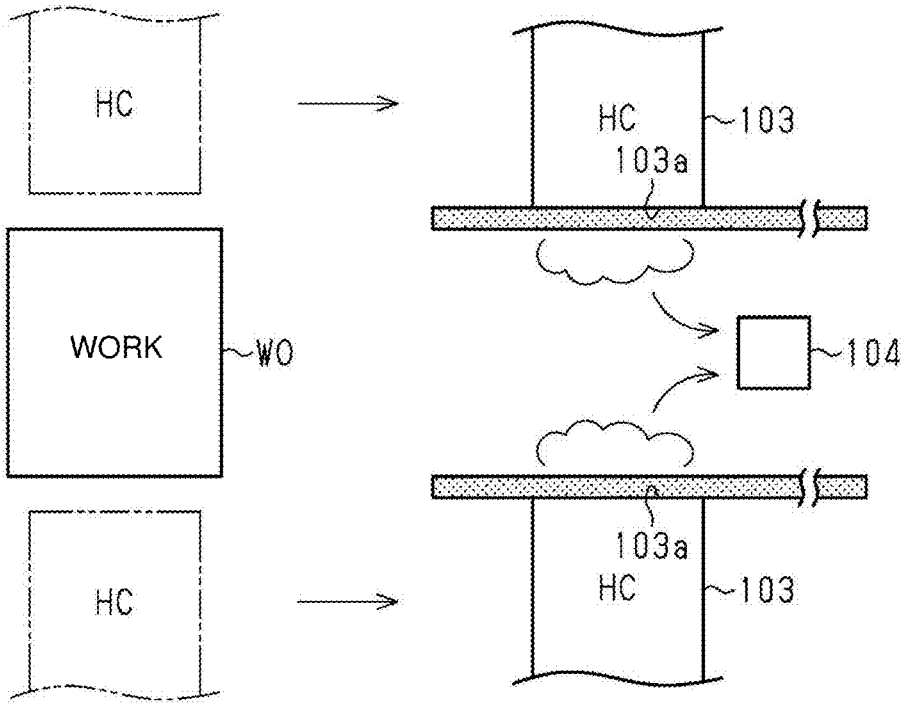
FIG. 7 is an illustration for describing the method for manufacturing the coil component.

As illustrated in FIG. 7, before the heating step, a grinding step of retracting the pressing member 103 below the drum core 11 and hoop element F (hereinafter, the combination of the drum core 11 and hoop element F is referred to as work WO) being conveyed and of grinding the leading end surface 103*a* of the pressing member 103 with a whetstone (not illustrated) may be used. Here, the adhesive (thermosetting resin) leaking when the metal terminals 51*a*, 51*b*, 51*c*, and 51*d* are connected by thermocompression bonding may be attached to the leading end surface 103*a* of the pressing member 103. If the adhesive clings to the leading end surface 103*a*, planarity of the leading end surface 103*a* may be lost, and as a result, the adhesive (resin) may be cured in the state where the metal terminals are inclined. In such a case, the planarity can be regained by grinding the leading end surface 103*a* with the whetstone in the grinding step. At this time, the whetstone may be set below the work WO (hoop element F) and substantially in parallel with the principal surface 31*a* of the flange portion 31 in the drum core 11. In this configuration, the leading end surface 103*a* of the pressing member 103 may be ground substantially in parallel. By grinding it below the work WO, grinding powder, which is produced by grinding, can be avoided from falling to the work WO under its own weight and becoming deposited on the work WO. The grinding power may be sucked by a suction device 104 during or after the grinding step. The grinding power deposited (remaining) on the leading end surface 103*a* may be eliminated by sweeping out the leading end surface 103*a* of the pressing member 103 with a brush (not illustrated). One example of the whetstone used in the grinding step may have a planar shape, and the grain size distribution of fine powder for precision grinding under the electrical resistance test method may be larger than about #320 and smaller than about #400 (Japanese Industrial Standards (JIS)).

The present embodiment described above can provide advantages below.

(1) In the method for manufacturing the coil component 10 according to the present embodiment, the adhesive between the metal terminals 51*a*, 51*b*, 51*c*, and 51*d* and the drum core 11 is cured by heating in the state where the metal terminals 51 are pressed by the pressing member 103 having the leading end surface 103*a* as the contact surface capable of coming into contact with the metal terminals 51*a*, 51*b*, 51*c*, and 51*d*. Here, in known examples, the adhesive is cured by heating with an oven or other heating device while the drum core 11 and the metal terminals 51*a*, 51*b*, 51*c*, and 51*d* are individually positioned and fixed by a jig. At this time, because the jig has a large thermal capacity, a temperature rise in the oven or other heating device takes time, and furthermore, the temperature cannot be adjusted finely. Unlike such known examples, according to the above-described embodiment, partial heating (thermocompression bonding) is performed while the pressing member 103 supports the work, thus allowing the adhesive to be cured before heat is conveyed to the jig having a large thermal capacity. Accordingly, the adhesive can be efficiently heated.

(2) Because the adhesive between the drum core 11 and the metal terminals 51*a*, 51*b*, 51*c*, and 51*d* is cured by the pressing member 103 capable of coming into contact with the metal terminals 51*a*, 51*b*, 51*c*, and 51*d*, and the lower-side jig 101, in the state where the drum core 11 is inserted in the hoop element F and they are linked together, heat is applied to only the portion to be subjected to thermocompression bonding of the metal terminals 51*a*, 51*b*, 51*c*, and 51*d*. That is, because the adhesive can be cured before heat is conveyed to a jig having a large thermal capacity (e.g., upper-side jig 102), the adhesive can be heated more efficiently, in comparison with the case where the drum core 11 and metal terminals 51*a*, 51*b*, 51*c*, and 51*d* are heated together with the jigs 101 and 102 in the state where the metal terminals 51*a*, 51*b*, 51*c*, and 51*d* are fixed by the jigs 101 and 102.

(3) If a foreign substance, such as an adhesive, is deposited on the leading end surface 103*a*, for example, the foreign substance can be removed in the grinding step of grinding the leading end surface 103*a* to be in contact with the metal terminals 51*a*, 51*b*, 51*c*, and 51*d* of the pressing member 103 before the heating step.

(4) Because an elastic force is exerted toward the center of the drum core 11 in the longitudinal direction Ld by the hoop element F, which is integral with the plurality of metal terminals 51*a*, 51*b*, 51*c*, and 51*d*, before the heating step, the drum core 11 is held in a predetermined position, and misalignment of the drum core 11 after the drum core 11 is inserted into the hoop element F can be suppressed.

(5) Because the heater chip is used as the pressing member 103 and it generates heat by itself, the generated heat can be efficiently conveyed to the adhesive. In addition, misalignment can be prevented by the application of pressure to the end surface portion 53 of the metal terminals 51*a*, 51*b*, 51*c*, and 51*d* and the principal surface 31*a* of the flange portion 31 in the drum core 11.

(Variations)

The above-described embodiment may also be carried out in modes below.

In the above-described embodiment, the adhesive between the principal surface 31*a* and the end surface portion 53 as end surfaces is heated, and the adhesive between the projecting surfaces 32*a* and 32*b* and the mounting portion 52 is heated. Other configurations may also be used. For example, a configuration in which at least only one of the adhesive on the end surface portion 53 and the adhesive on the mounting portion 52 is heated may also be used.

In the above-described embodiment, the hoop element F is deformed such that the upper portions of the grip portions F1*a*, F1*b*, F1*c*, and F1*d* (metal terminals 51*a*, 51*b*, 51*c*, and 51*d*) are widened to facilitate insertion of the drum core 11. The hoop element F may not be deformed. At this time, holding by a generated elastic force is optional.

In the above-described embodiment, the grinding step of grinding the leading end surface 103*a* of the pressing member 103 is used before the heating step. The grinding step may be omitted.

Although not mentioned in above-described embodiment, the adhesive may be cured in the heating step by the pressing member 103 as the heating section to, for example, the degree where the metal terminals 51*a*, 51*b*, 51*c*, and 51*d* and the drum core 11 are not separated, and in a subsequent step, the adhesive may be fully cured by further heating by, for example, being placed into an oven or other heating device.

In the above-described embodiment, the heating step is performed by the pressing member 103 and lower-side jig 101 in contact with the work. The thermocompression bonding may not be carried out by the pressing member.

In above-described embodiment, a common-mode choke coil is used as the coil component 10. The above-described configurations may also be applied to other coils.

The above-described embodiment and variations may be combined as appropriate.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A method for manufacturing a coil component including a core including a winding core portion and a pair of flange portions on opposite ends of the winding core portion, at least one metal terminal joined and fixed to one of the pair of flange portions, and a wire wound around the winding core portion and including an extended portion electrically connected to the at least one metal terminal, the method comprising:

locally heating the at least one metal terminal while the at least one metal terminal is supported by a pressing member having a contact surface capable of coming into contact with the at least one metal terminal in a state where a thermosetting adhesive is disposed between the at least one metal terminal and the core.

2. The method for manufacturing the coil component according to claim 1, wherein the heating is performed while the at least one metal terminal is pressed by the pressing member from the at least one metal terminal toward the core.

3. The method for manufacturing the coil component according to claim 2, further comprising:

grinding the contact surface of the pressing member to be in contact with the at least one metal terminal before the heating.

4. The method for manufacturing the coil component according to claim 3, further comprising:

preparing a hoop element integral with the at least one metal terminal and holding the core in a predetermined position by the hoop element before the heating.

5. The method for manufacturing the coil component according to claim 4, wherein the pressing member is a heater chip.

6. The method for manufacturing the coil component according to claim 3, wherein the pressing member is a heater chip.

7. The method for manufacturing the coil component according to claim 2, further comprising:

preparing a hoop element integral with the at least one metal terminal and holding the core in a predetermined position by the hoop element before the heating.

8. The method for manufacturing the coil component according to claim 7, wherein the pressing member is a heater chip.

9. The method for manufacturing the coil component according to claim 2, wherein the pressing member is a heater chip.

10. The method for manufacturing the coil component according to claim 1, further comprising:

preparing a hoop element integral with the at least one metal terminal and holding the core in a predetermined position by the hoop element before the heating.

11. The method for manufacturing the coil component according to claim 10, wherein the pressing member is a heater chip.

12. The method for manufacturing the coil component according to claim 1, wherein the pressing member is a heater chip.

13. The method for manufacturing the coil component according to claim 1, wherein the at least one metal terminal is directly joined and fixed to the one of the pair of flange portions.

* * * * *